United States Patent [19]

Naves

[11] 4,238,168

[45] Dec. 9, 1980

[54] RAILWAY CAR FOR TRANSPORTING VEHICLES

[75] Inventor: David G. Naves, Ypsilanti, Mich.

[73] Assignee: Pullman Incorporated, Chicago, Ill.

[21] Appl. No.: 973,830

[22] Filed: Dec. 28, 1978

[51] Int. Cl.[3] ..... B61D 3/16; F16F 1/06

[52] U.S. Cl. ..... 410/27; 105/370

[58] Field of Search ..... 105/371; 296/24 R; 410/26, 27, 15; 74/526

[56] References Cited

U.S. PATENT DOCUMENTS

| | | | |
|---|---|---|---|
| 2,802,429 | 8/1957 | Storch | 410/15 |
| 3,405,661 | 10/1968 | Erickson et al. | 105/371 |
| 3,449,010 | 6/1979 | Hoy | 410/26 |
| 3,866,543 | 2/1975 | Richard | 74/526 |
| 3,913,496 | 10/1975 | Lohr | 410/27 |
| 3,927,621 | 12/1975 | Skeltis et al. | 410/29 |
| 4,119,042 | 10/1978 | Naves et al. | 410/27 |
| 4,119,043 | 10/1978 | Naves et al. | 410/27 |

*Primary Examiner*—Richard A. Bertsch

*Attorney, Agent, or Firm*—Richard J. Myers; Stephen D. Geimer

[57] ABSTRACT

A railway car for transporting vehicles comprising a plurality of vertically spaced decks, one of which consists of a rigid central section and at opposite ends hinged deck sections that are adapted to be selectively raised for facilitating the loading of vehicles onto the railway car, and an improved counterbalancing and locking mechanism interconnecting the hinged deck sections and the car structure.

19 Claims, 6 Drawing Figures

RAILWAY CAR FOR TRANSPORTING VEHICLES

BACKGROUND OF THE INVENTION

1. Field of the Invention

The invention relates to railway cars and particularly to a rack and decking arrangement for transporting automobiles and other vehicles on the car.

2. Description of the Prior Art

The prior art is disclosed in U.S. Pat. Nos. 2,802,429, Aug. 13, 1957; 3,405,661, Oct. 15, 1968; 3,449,010, June 10, 1969; 3,866,543, Feb. 18, 1975. The present invention is an improvement over the prior art.

Related patent applications are Ser. No. 772,200 filed Feb. 25, 1977 issued Oct. 10, 1978, as U.S. Pat. No. 4,119,042, and Ser. No. 775,824, filed Mar. 9, 1977 issued Oct. 10, 1978 as U.S. Pat. No. 4,119,043.

SUMMARY OF THE INVENTION

A railway car for transporting motor vehicles includes a floor, a plurality of vertically spaced decks, and a plurality of longitudinally spaced vertical posts which support the decks from opposite sides thereof. At least one of the decks includes a rigid central section and hinged sections at either end, which can be selectively raised to facilitate loading of motor vehicles onto the deck below. The hinged sections are interconnected with the car structure by a spring-counterbalancing mechanism which exerts a continually biasing force in an upward direction in order to facilitate movement of the deck by one man. A locking mechanism locks the hinged deck portions in either the raised or lowered position to prevent accidental movement of the deck during loading or shipment.

The present invention improves on prior designs by providing a counterbalancing mechanism which includes a lever with a longitudinally movable roller cam operatively interconnecting each spring-biased tension rod with its respective hinged deck section. This arrangement is less susceptible to jamming which may be caused by debris in the operating environment or by minor misalignment of the mechanism, and provides smoother, more maintenance-free operation. In addition, an improved locking arrangement which includes a spring-loaded latch and slidingly movable actuating rod and handle facilitates more convenient operation by a vehicle operator.

DESCRIPTION OF PREFERRED EMBODIMENT

Figure 1:
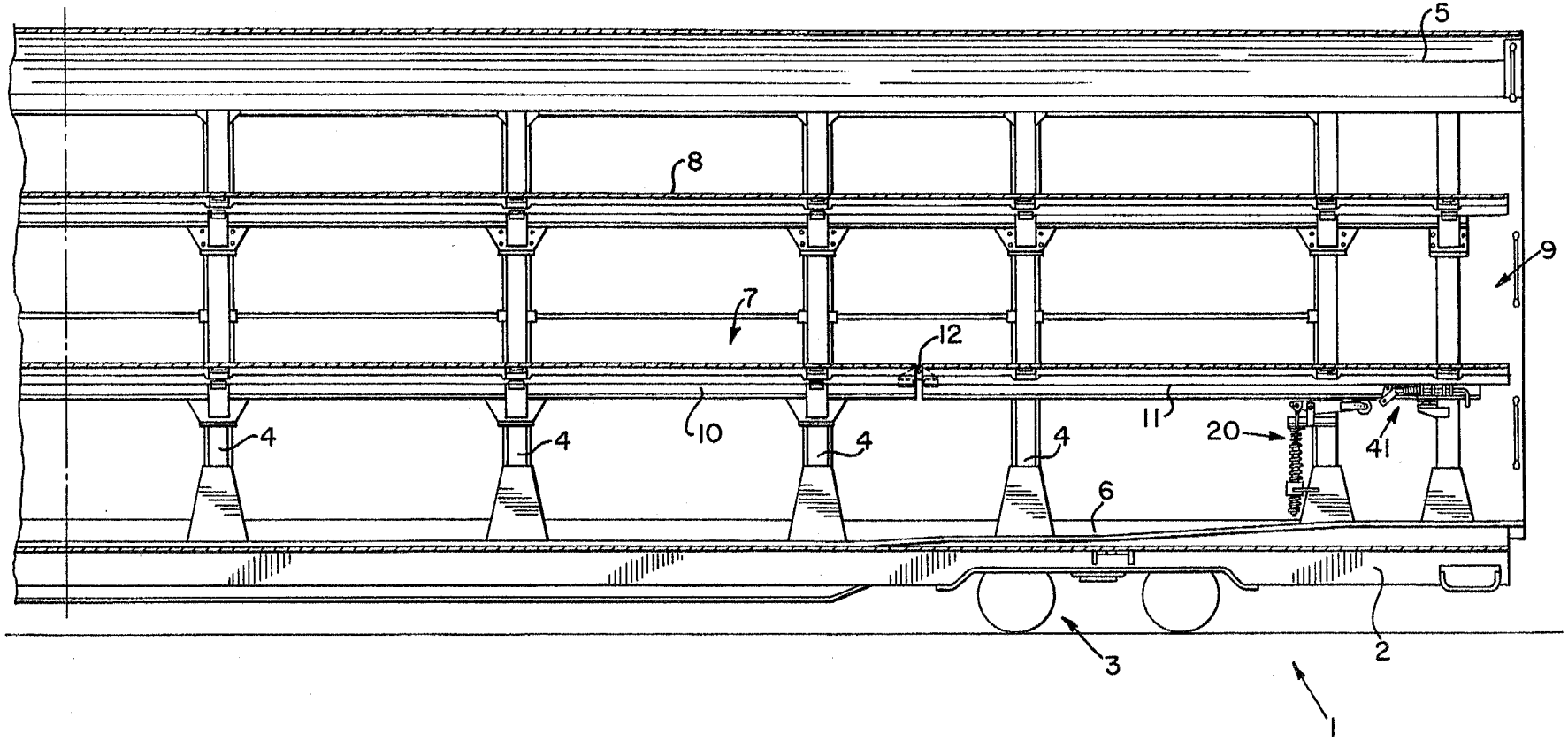
FIG. 1 is a side elevational view of approximately one-half of a railway car which is symmetrical.

Referring to FIG. 1, a railway car 1 particularly adapted for carrying motor vehicles and the like includes an underframe 2 supported on conventional wheel trucks 3. The railway car 1 has a rack structure supported thereon comprising a plurality of longitudinally spaced upright posts 4 mounted on opposite sides of car 1. The upright posts 4 support a roof structure 5 and the car includes a lower deck or floor 6. The rack is of multiple support construction including a first upper deck 7 and a second upper deck 8. The car is open at opposite ends and may be loaded by driving vehicles onto the floor and decks of the car. The open ends of the car are designated at 9. It is of course obvious that the rack, if desired, may be suitably covered by a protective paneling as well as the ends may be closed for security and protective purposes.

The first upper deck 7 comprises a first rigid deck section 10 suitably supported on upright posts 4. A movable hinged second deck section 11 is connected to each of the ends of the rigid deck section 10 and is hingedly movable with respect thereto by hinge brackets 12 laterally spaced along the contiguous edges of the sections 10 and 11. Each of the deck sections 10 and 11 also comprises a platform 13 onto which automobiles are driven. The platform 13 is suitably supported on opposite sides thereof by means of longitudinally extending channels 14, and longitudinal stringers 24 may be suitably connected underneath the side of the platform 13 for reinforcing the same. The structure of the decks is substantially conventional and need not be further described. When in its lower) vehicle-carrying position, the end of the hinged section 11 is supported on the posts 4 so that the hinged section 11 is in substantially linear relation with respect to the rigid deck 10. Reinforcing gussets 15 are suitably connected to the channels 14 and are longitudinally spaced along the channels 14 to reinforce the same in connection with the platform 13. Plates 16 are mounted on the lower surface of hinged section 11 near the end thereof and include a cone-shaped indentation 17 providing a socket for engaging and seating upon a cone-shaped support element 18 suitably mounted on a bracket 19 connected to a side post 4. By virtue of this arrangement the end of the deck section 11 in the down position is firmly seated on seats 18 and supported by the side posts 4.

Figure 4:
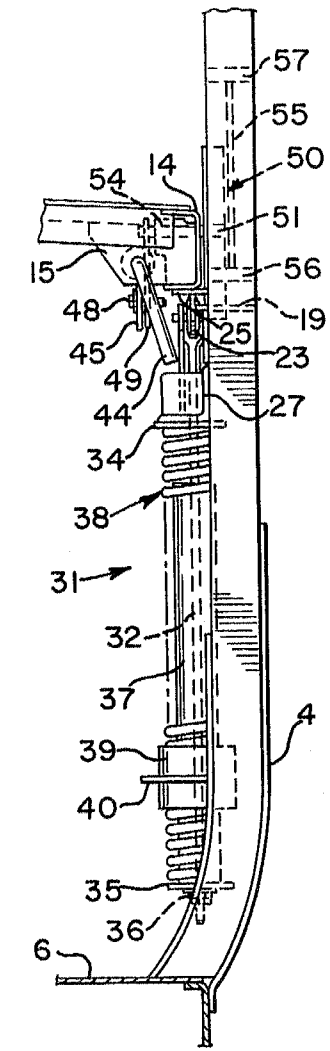
FIG. 4 is a cross-sectional view taken substantially along lines 4—4 of FIG. 2.
Figure 2:
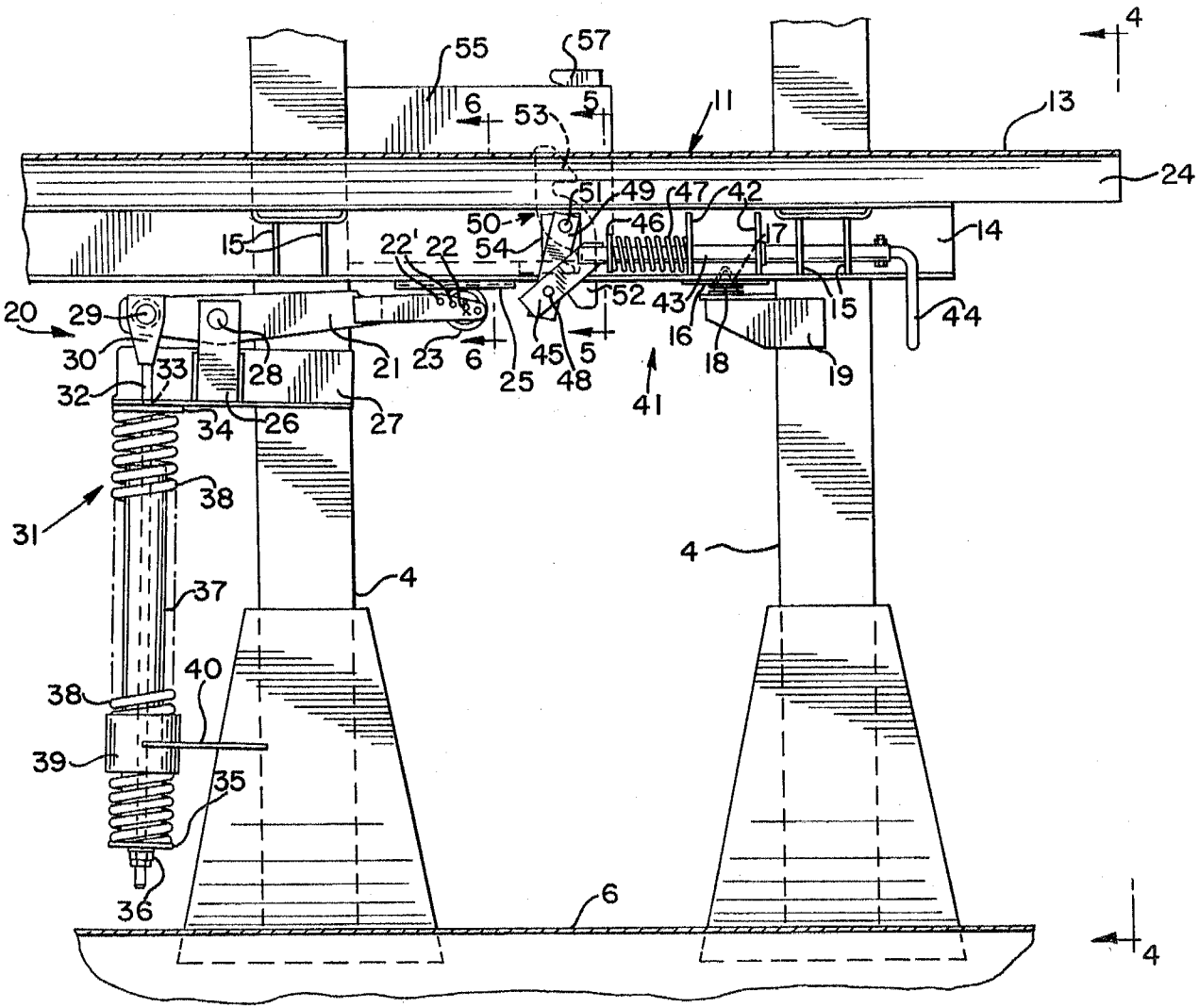
FIG. 2 is an enlarged cross-sectional view partially in elevation disclosing a counterbalancing and locking mechanism positioned on opposite sides of a railway car.
Figure 5:
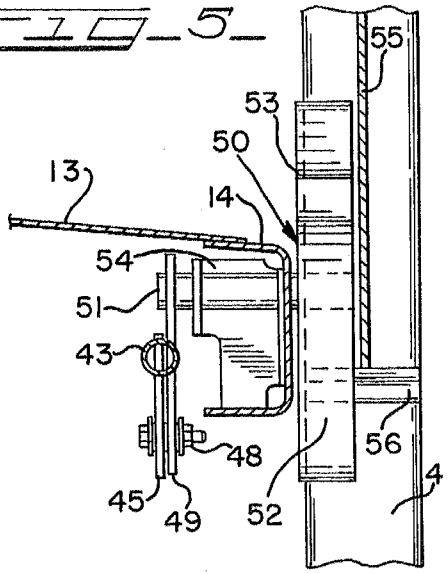
FIG. 5 is a cross-sectional view taken substantially along lines 5—5 of FIG. 2.
Figure 6:
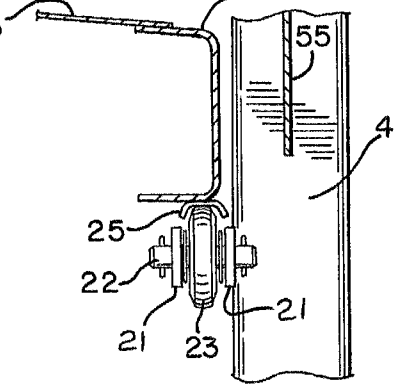
FIG. 6 is a cross-sectional view taken substantially along lines 6—6 of FIG. 2.
Figure 3:
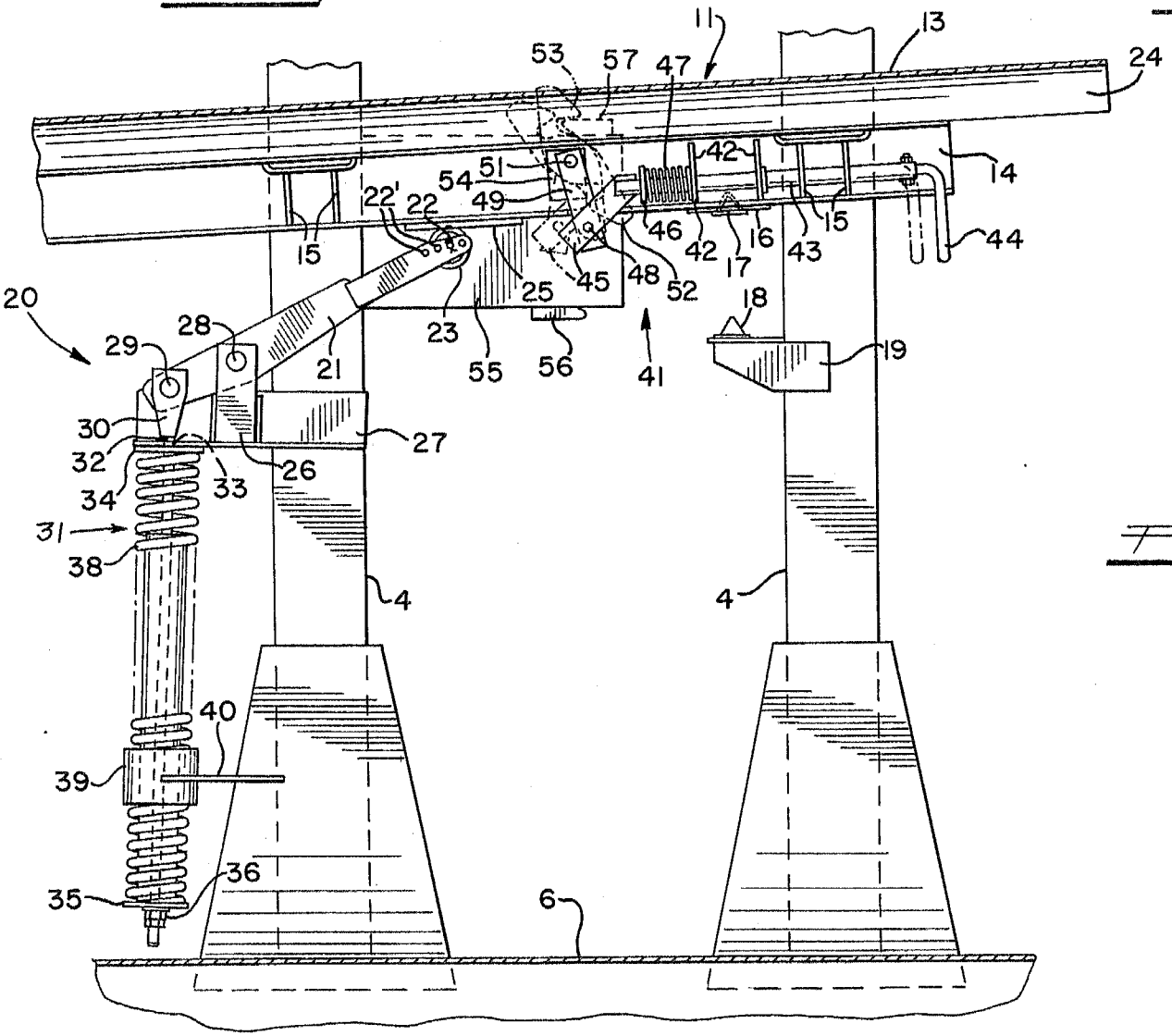
FIG. 3 is a view similar to FIG. 2 disclosing another operating position of a counterbalancing and locking mechanism.

Referring particularly to FIGS. 2 through 4, a spring-counterbalancing arrangement 20 comprises a lever 21 having at one end thereof a pivot pin 22 supporting a roller cam 23 which biasingly reacts against channel 14 through roller plate 25. Pivot pin 22 is selectively positionable in one of roller adjustment holes 22'. Between the ends of the lever 21 there is provided pivot bracket 26 on a flange bracket 27 carried by one of the posts 4 which includes a pivot pin 28 pivotally supporting the lever 21 on bracket 26.

The opposite end of the lever 21 is provided with a pivot pin 29 extending through clevis member 30 to which is connected a spring assembly generally designated by the reference character 31.

The spring assembly 31 comprises a tension rod 32 rigidily connected to clevis member 30 and projecting through opening 33 in the flange bracket 27. The upper end of the spring assembly 31 includes a spring plate 34, and a lower retainer plate 35 is supported on the tension rod 32 by means of nut 36 threaded onto the end of the tension rod 32. Spring plate 34 is suitably slideable on the tension rod 32. A spring guide 37 is supported by the retainer plate 35 and the tension rod 32 extends therethrough. A coil spring 38 is captively held between the plates 34 and 35 providing the biasing means for the assembly. A tubular spring guide 39 is suitably connected by means of a guide bracket 40 to the post structure 4 for guiding the vertical movement of the spring 38 and spring retainer plate 35.

As shown in FIGS. 2 through 4 a locking arrangement generally designated as 41 comprises a housing 42 which is supported within the channel 14 to the right of counterbalancing arrangement 20. A slidingly movable rod 43 is supported within the housing 42 and extends through reinforcing gussets 15 where an operating handle 44 is rigidly attached thereto. Movable rod 43 comprises rigidily attached rod link 45 and rigidily attached spring retainer washer 46. Rod 43 passes through return spring 47 situated thereon. Return spring 47 is restrictively held between spring retainer washer 46 and housing 42, and biasingly reacts against these two components. Rod link 45 is pivotally attached at link pivot 48 to latch link 49. Latch link 49 is rigidily connected to latch shaft 51 which is rotatably supported by channel bracket 54. Latch shaft 51 passes through channel bracket 54 and channel 14 and is rigidily connected to vertically extending latch arm 50, having at its lower end a hook-shaped keeper engaging member 52 extending in one direction and at its upper end another similar keeper engaging member 53 extending in an opposite direction. Link pivot 48 is located at a greater distance from the latch shaft 51 than lower keeper engaging member 52 or upper keeper engaging member 53, thereby facilitating mechanically advantageous movement of rod 43 relative to latch arm 50.

Extending longitudinally from side post 4 is rigidily attached keeper tab mounting 55 from which rigidily attached lower keeper tab 56 projects so as to be engaged by a lower keeper engaging member 52 when the hinged deck portion 11 is in the lower position. A similar upper keeper tab 57, also rigidly attached to keeper tab mounting 55, is vertically disposed above lower keeper tab 56 so as to be engaged by upper keeper engaging member 53 when the hinged deck portion 11 is in the upper position.

OPERATION OF THE INVENTION

The loading of vehicles onto the railway car 1 is conventional, the vehicles being driven onto the lower deck or floor 6 and onto the upper decks 7 and 8 from suitably elevated ramps. During loading of the lower deck or floor 6 it is desired, in order to facilitate the loading, to raise the hinged deck section 11 about the hinge brackets 12 so that the outer ends of deck section 11 are raised upwardly. Locking assemblies 41 and counterbalancing mechanisms 20 are provided on each side of the car. In the down position the movable rod 43 and operating handle 44 are in the position shown in FIG. 2 wherein the hook-shaped lower keeper engaging member 52 is in engagement with the lower keeper tab 56 preventing upward movement of the deck. Cone-shaped element 18 fits within cone-shaped indentation 17 to assure proper alignment of deck section 11 in the down position.

To raise the deck section 11, an operator grasps and pulls handle 44 slidingly moving rod 43 and rod link 45. Rod link 45 acts through link pivot 48 to rotate latch link 49, latch shaft 51 and latch arm 50, thus releasing the lower keeper engaging member 52 from keeper tab 56. The spring-counterbalancing mechanism 20 provides for upwardly biased movement of deck section 11 as roller cam 23 acts against roller plate 25 to assist the operator who is moving the hinged deck 11 into its raised position. The spring assembly 31 continually urges the lever 21 into the raised position since the coil spring 38 is compressed against spring plate 34, which is held in place by flange bracket 27, thereby urging the tension rod 32 to be moved downwardly. The spring guide 39 serves to maintain the action of the spring in a vertical and guided relation.

As deck section 11 moves to its uppermost position, the upper surface of hook-shaped upper keeper engaging member 53 cams against the lower surface of upper keeper tab 57 until member 53 engages with keeper tab 57, as shown in FIG. 3. The deck section 11 is now locked in the raised position, and vehicles may be loaded onto the lower deck floor 6 of the railway car 1.

To lower the deck section 11 operators again pull handle 44, which slidingly moves rod 43 and rod link 45, and causes latch link 49, latch shaft 51 and latch arm 50 to rotate, disengaging upper keeper engaging member 53 from keeper tab 57. Deck section 11 can now be easily lowered to the down position, as spring-counterbalancing mechanism 20 acts biasingly against the downward movement of the deck section 11 to prevent uncontrolled descent of the deck. As the deck section 11 moves to its vehicle-carrying position, the lower surface of lower keeper engaging member 52 cams against the upper surface of keeper tab 56, until member 52 again engages keeper tab 56 to lock deck section 11 in the down position.

In both the raised and lowered positions, return spring 47 provides constant urging against spring retainer washer 46, which prevents locking mechanism 41 from accidently disengaging during loading or shipment.

The biasing effect and alignment of counterbalancing mechanism 20 may be varied by repositioning roller cam 23 and pivot pin 22 in any one of roller adjustment holes 22'.

What is claimed is:

1. In a transportation device for carrying vehicles including a body having a floor, side support means extending upward from said floor, a generally horizontal deck supported on said side support means, said deck including a movable section thereof selectively positionable in vehicle-carrying and vehicle-loading positon, counter-balancing means operatively associated with said movable section to accommodate selective vertical positioning thereof by a vehicle operator, and a locking mechanism for locking said movable section in said vehicle-carrying and vehicle-loading positions comprising:

a rotatable latch, including a hook-shaped member, carried by said movable section, a linearly reciprocable member carried by said movable section, a keeper tab rigidly affixed to said side support means releasably engageable by said hook-shaped member for maintaining said movable section in selected positon, linking means operatively interconnecting said reciprocable member to said rotatable latch, whereby movement of said reciprocable member disengages said hook-shaped member from said associated keeper tab, and biasing means supported by said movable section urging said rotatable latch into a keeper tab engagement disposition relative to said movable section.

2. The invention in accordance with claim 1, said reciprocable member including a handle accomodating movement of said member by a vehicle operator.

3. The invention in accordance with claim 1, said side support means including support means engageable with an outer end of said movable section when said movable section is in a vehicle-carrying position.

4. The invention in accordance with claim 1, camming means operatively associating releasable engagement of said latch and said keeper tab.

5. The invention in accordance with claim 1, said linking means being pivotally connected to said rotatable latch at a distance from the axis of rotation of said rotatable latch greater than the distance between said hook-shaped member and the axis thereby facilitating mechanically advantageous movement of said reciprocable member relative to said rotatable latch.

6. In a transportation device for carrying vehicles including a body having a floor, side support means extending upward from said floor, a generally horizontal deck supported on said side support means, said deck including a movable section thereof selectively positionable in vehicle-carrying and vehicle-loading positions, counter-balancing means operatively associated with said movable section to accommodate selective vertical positioning thereof by a vehicle operator, and a locking mechanism for positively locking said movable section in said vehicle-carrying and vehicle-loading positions comprising:

a rotatable, hook-shaped latch supported by said movable section, a reciprocably sliding member supported by said movable section, linking means operatively interconnecting said sliding member to said rotatable latch thereby converting linear motion of said sliding member into rotary motion of said rotatable latch, a keeper tab rigidly affixed to said side support means releasably engageable by said hook-shaped latch for maintaining said movable section in selected position, and biasing means supported by said movable section constantly urging said rotatable latch into a keeper tab engagement disposition relative to said movable section.

7. The invention in accordance with claim 6, said reciprocably sliding member including a handle facilitating movement of said member by a vehicle operator.

8. The invention in accordance with claim 6, said side support means including support means engageable with an outer end of said movable section when said movable section is in a vehicle-carrying position.

9. The invention in accordance with claim 6, camming means operatively associating releasable engagement of said latch and said keeper tab.

10. In a transportation device for carrying vehicles including a body having a lower vehicle supporting floor, a plurality of longitudinally spaced upright side posts connected to said body on opposite sides of said floor, a deck supported on said side posts in vertically spaced relation above said floor, said deck including a first vehicle-carrying section rigidly connected to said posts, a second vehicle-carrying section of said deck including hinge means connected to one end of said second section and to said first section whereupon the other end of said second section may be swung upwardly between vehicle-carrying and non-carrying positions, and a counterbalancing arrangement for said second deck section including:

a lever, pivot means intermediate on said lever supporting said lever on one of said posts, biasing means supported on one of said posts, and means pivotally connecting the same to a first end of said lever for creating an upward force at a second end of said lever, and roller means mounted to said second end of said lever for transferring said upwared force from said second end of said lever to said second vehicle-carrying section.

11. The invention in accordance with claim 10, said roller means comprising a roller cam rotatable in a vertical plane mounted at said second end of said lever so as to be in constant rolling engagement of lower surface of said second section.

12. The invention in accordance with claim 11, said second end of said lever including a plurality of supports for said roller cam for selective relative positioning thereof.

13. The invention in accordance with claim 12, one of said side posts including supporting means for engagement with an outer end of said second section in a vehicle supporting position.

14. The invention in accordance with claim 13, including locking means on said second section for selectively locking the same in either of said vehicle-carrying or non-carrying positions.

15. The invention in accordance with claim 14, said locking means comprising, a support housing rigidly attached to said second section, a slidingly movable rod having first and second ends supported by and extending through said housing so as to be longitudinally reciprocable a vertically disposed rod link rigidly attached to said first end of said rod a vertically disposed latch rotatable in a vertical plane, a relatively short horizontally disposed rotatable shaft supported by said second section having a first and second end, said first end being rigidly affixed at the axis of rotation of said latch and said second end being rigidly affixed to a vertically disposed, rotatable latch link thereby accommodating simultaneous rotation of said latch and said latch link, a link pivot pivotally connecting said rod link to said latch link such that movement of said rod link rotates said latch link, said shaft, and said latch in unison.

16. The invention in accordance with claim 15, said latch including upper and lower oppositely disposed hook-shaped keeper engagement members.

17. The invention in accordance with claim 16, including upper and lower keeper tabs rigidly attached to said side posts for selective engagement by said upper or lower keeper engagement members of said latch, respectively.

18. The invention in accordance with claim 17, said latch constantly urged to a vertically disposed keeper engagement position by a return spring captively supported on said slidingly movable rod between said support housing and a spring retainer washer rigidly affixed to said rod.

19. The invention in accordance with claim 18, including operator handle means rigidly affixed to said second end of said rod facilitating sliding movement thereof.

* * * * *